US011833536B2

(12) United States Patent
Kwiatkowski

(10) Patent No.: US 11,833,536 B2
(45) Date of Patent: Dec. 5, 2023

(54) GRASS HOLE SYSTEM

(71) Applicant: GRASS HOLE CORPORATION, Bradenton, FL (US)

(72) Inventor: Kenneth Joseph Kwiatkowski, Bradenton, FL (US)

(73) Assignee: GRASS HOLE CORPORATION, Bradenton, FL (US)

( * ) Notice: Subject to any disclaimer, the term of this patent is extended or adjusted under 35 U.S.C. 154(b) by 106 days.

(21) Appl. No.: 17/449,702

(22) Filed: Oct. 1, 2021

(65) Prior Publication Data

US 2022/0105533 A1 Apr. 7, 2022

Related U.S. Application Data

(60) Provisional application No. 63/087,355, filed on Oct. 5, 2020.

(51) Int. Cl.
*B05B 15/16* (2018.01)

(52) U.S. Cl.
CPC ..... *B05B 15/16* (2018.02)

(58) Field of Classification Search
CPC ..... B05B 15/16; B05B 15/622; A01G 13/10; A01G 25/00; H02G 3/085; H02G 3/0691; H02G 3/083; E03B 7/095; Y10T 137/7043; B65D 25/005
USPC ..... 239/288.3
See application file for complete search history.

(56) References Cited

U.S. PATENT DOCUMENTS

| | | | | |
|---|---|---|---|---|
| 10,919,068 | B1 * | 2/2021 | Newmeyer | B05B 15/622 |
| 2009/0173397 | A1 * | 7/2009 | Mallela | F16L 5/00 137/364 |
| 2014/0263343 | A1 * | 9/2014 | Geerligs | E03B 7/095 220/484 |
| 2015/0176239 | A1 * | 6/2015 | Ducote | E02D 29/12 137/377 |
| 2016/0082462 | A1 * | 3/2016 | McDougald | B05B 15/16 239/288.3 |
| 2017/0320086 | A1 * | 11/2017 | Orth | B05B 15/16 |

* cited by examiner

*Primary Examiner* — Qingzhang Zhou
*Assistant Examiner* — Juan C Barrera
(74) *Attorney, Agent, or Firm* — Shumaker, Loop & Kendrick, LLP; James D. Miller

(57) ABSTRACT

A cover for protecting ground-installed structures includes a tube and a flanged portion. The tube defines an opening for receiving the ground-installed structure therein. The tube is formed by a circumferential wall having at least one removable formed therein. Each of the removables is configured to be selectively removed to promote entry of a fluid line or cable into the opening for connection to the ground-installed structure. A flanged portion extends radially outwardly from the tube with the flanged portion including at least one separation feature for changing a perimeter shape of the flanged portion.

11 Claims, 4 Drawing Sheets

GRASS HOLE SYSTEM

CROSS-REFERENCE TO RELATED PATENT APPLICATION

This patent application claims priority to U.S. Provisional Patent Application Ser. No. 63/087,355, filed on Oct. 5, 2020, the entire disclosure of which is hereby incorporated herein by reference.

FIELD

The present invention relates generally to a system for protecting ground-installed structures such as sprinkler heads and light fixtures, and more specifically, a tubular structure having customizable features for accommodating a variety of different configurations of the related ground-installed structures and surrounding areas.

BACKGROUND OF THE INVENTION

It is common for yards, gardens, and other outdoor landscaping features to include structures installed into a ground surface thereof. Such ground-installed structures include sprinkler heads, light fixtures, flagpoles, ornaments, and the like. The disposition of such structures directly into the corresponding yard or landscaping feature often subjects these structures to potential interference when attempting to maintain the surrounding yard or landscaping feature. For example, sprinkler heads are commonly located directly within a yard with grass surrounding a perimeter of the sprinkler head. Common maintenance tasks such as mowing or weed whipping may lead to accidental damage to the maintenance tool, the sprinkler head, or both. This often occurs because such ground-installed structures may be difficult to see during such tasks or because such ground-installed structures are not adequately protected from this undesired interference when accidental contact is made. This may be especially true when a third party who is not familiar with the layout of the yard or related landscaping feature is performing the associated maintenance tasks.

One known solution to these problems includes providing a cover or the like for preventing direct contact between the maintenance tool (mower, string trimmer, etc.) and the protected ground-installed structure while also aiding in more easily identifying the location of such ground-installed structures when performing these maintenance tasks. One example may be the Sprinkler Saver® cover, which includes a dome-like structure surrounding the exposed portion of the sprinkler head as well as a tubular structure extending into the ground for establishing a position of the cover relative to the corresponding sprinkler head. The tubular structure further includes a pair of opposing openings extending from an edge of the tubular structure for receiving water lines or the like therethrough for communicating a water supply to the sprinkler head. Other related products may similarly include donut-shaped structures that are similarly disposed to surround the sprinkler head or similar ground disposed structure.

Such products are subject to several shortcomings. First, the donut or dome shape of such existing covers provides a large and unattractive profile that is not aesthetically pleasing. Second, these annular donut or dome shapes tend to eliminate any ability to customize the appearance or positioning of such covers for unique circumstances. For example, it is not uncommon for such ground-installed structures to be disposed immediately adjacent other structures such as the side of a building structure, a driveway, a cement block, plant, or the like. The fixed and protruding shape of such covers renders it difficult to install such covers over the corresponding ground structure if any of these adjacent features interfere in any way. This may be especially true near corners or the like, where the annular shape of the cover cannot be fit within the corresponding corner. Lastly, the fixed configuration of such covers also forces the installer to adjust any related systems, such as the water lines feeding into a sprinkler head, to the configuration of the cover and any provided openings. This can greatly limit the available configurations that can be used for a given application.

It would accordingly be desirable to provide a cover for ground-installed structures with the cover having a reduced profile, an improved appearance, and customizable features for adjusting the cover to a variety of configurations and implementations.

SUMMARY OF THE INVENTION

Consistent and consonant with the present invention, an improved cover for ground-installed structures has been surprisingly discovered.

According to an embodiment of the invention, a cover for protecting a ground-installed structure includes a tube and a flanged portion. The tube defines an opening for receiving the ground-installed structure therein. The flanged portion extends radially outwardly from the tube. The flanged portion includes at least one first separation feature for changing a perimeter shape of the flanged portion. The flanged portion may be configured to rest on a ground surface when the cover is installed around the ground-installed structure.

According to further aspects of the present invention, the tube includes a circumferential wall having at least one removable formed therein. Each of the at least one removables may be configured to be selectively removed from the circumferential wall to promote entry of a fluid line or a cable into the opening for connection to the ground-installed structure. In some embodiments, at least a portion of a periphery of the at least one removable is formed by an end of the tube. In some embodiments, at least a portion of a periphery of the at least one removable is formed by a slot extending through the circumferential wall. In some embodiments, at least a portion of a periphery of the at least one removable is formed by at least one second separation feature. The at least one second separation feature may be formed in the circumferential wall. The at least one second separation feature may be one of an indentation, a perforation, a scored portion, or combinations thereof. The at least one second separation feature may extend transversely from a slot formed through the circumferential wall. The at least one second separation feature may extend to an end of the tube. A plurality of the second separation features may extend transversely from the slot.

In some embodiments, the flanged portion includes a plurality of first separation features. At least two of the plurality of the first separation features may be arranged transversely to each other. At least two of the plurality of the first separation features may intersect each other. Adjacent ones of the plurality of the first separation features may be spaced apart from each other with respect to a radial direction of the tube. The plurality of the first separation features may be arranged in a grid pattern. The at least one first separation feature may be one of an indentation, a perforation, a scored portion, or combinations thereof formed in the flanged portion.

In some embodiments, the tube and the flanged portion are monolithically formed. The cover may be molded or cast monolithically from a polymeric material. The polymeric material may be a plastic material.

BRIEF DESCRIPTION OF THE DRAWINGS

The above-mentioned, and other features and objects of the inventions, and the manner of attaining them will become more apparent and the invention itself will be better understood by reference to the following description of an embodiment of the invention taken in conjunction with the accompanying drawings, wherein.

DETAILED DESCRIPTION OF AN EMBODIMENT

Figure 1:
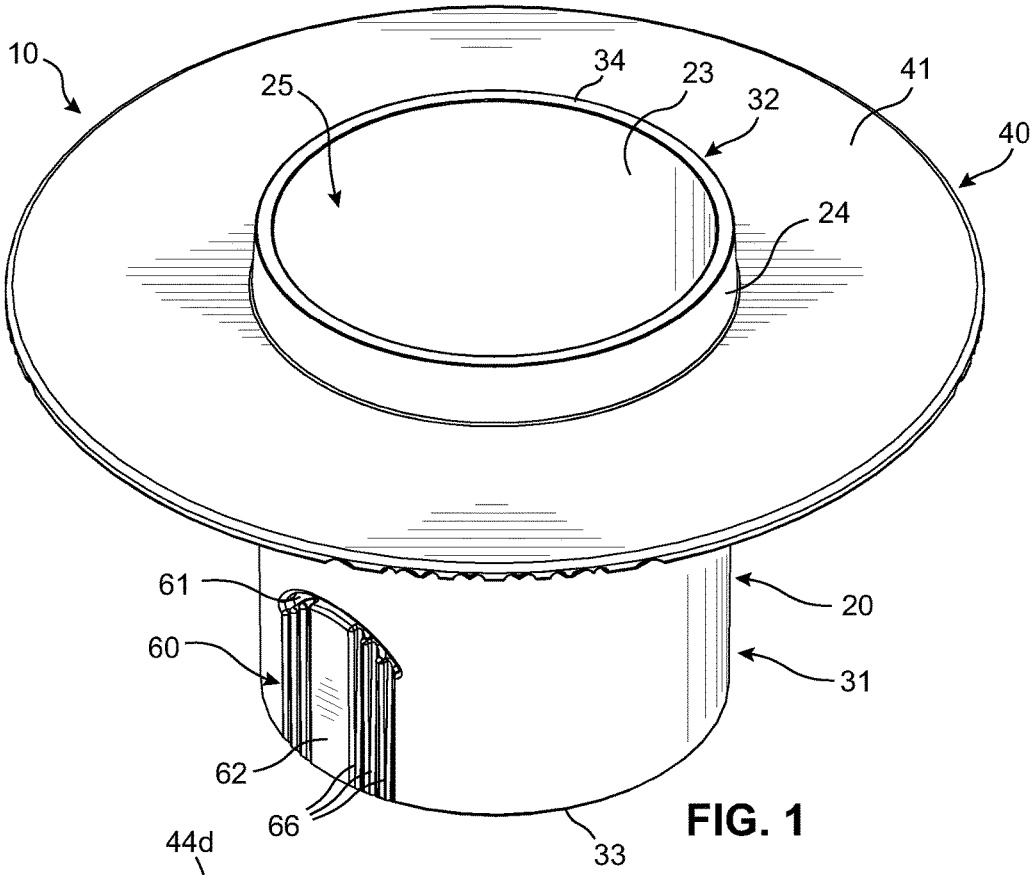
FIG. 1 is a top perspective view of a cover according to an embodiment of the present invention.
Figure 2:
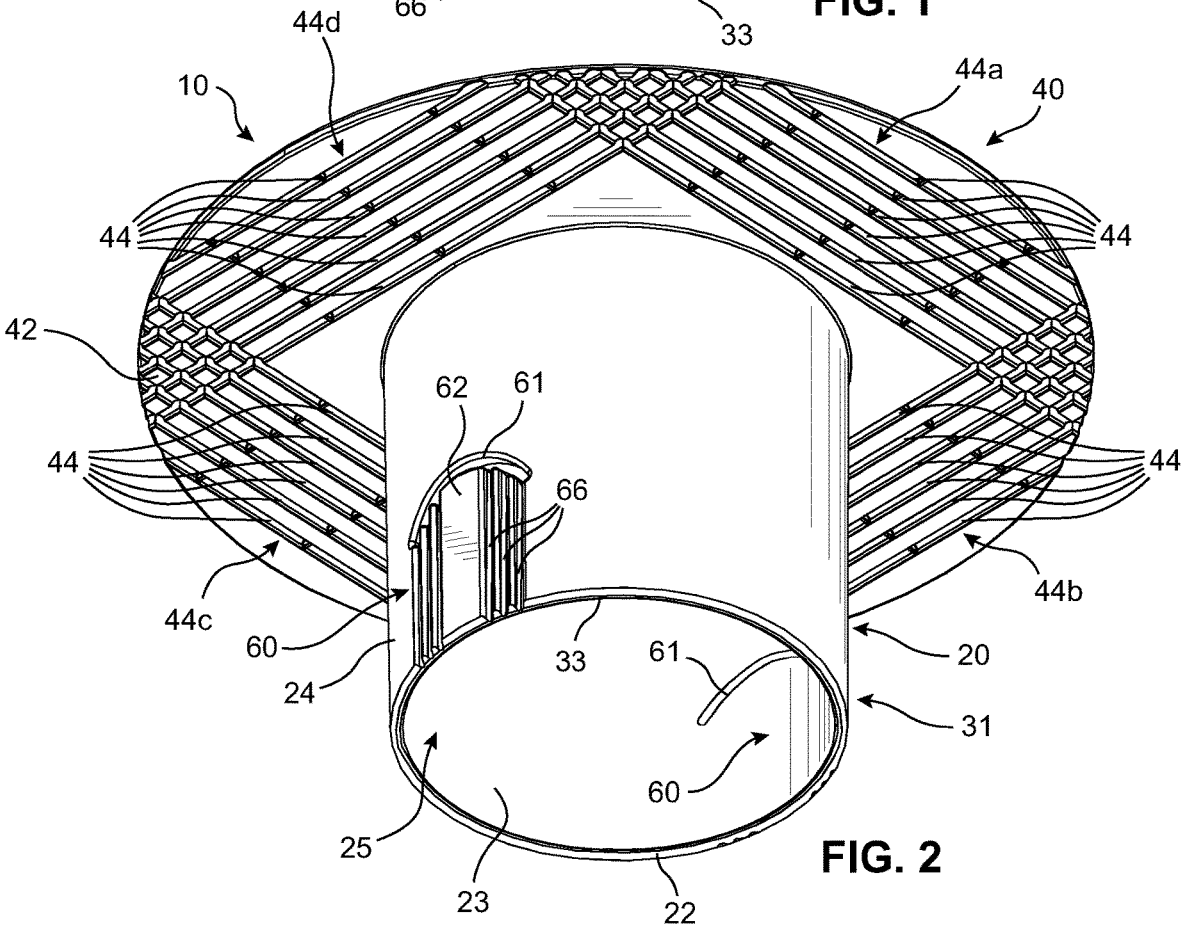
FIG. 2 is a bottom perspective view of the cover.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIGS. 1-4 illustrate a cover 10 for use in covering ground-installed structures as may be found in yards, gardens, or other similar landscaping features. The ground-installed structures may include sprinkler heads, light fixtures, posts, flag poles, decorations, ornaments, or the like that project at least partially out of the corresponding ground surface or rest directly on top of the ground surface, depending on the circumstances. The cover 10 may alternatively be referred to as a surround structure, location identifier, or growth deterrent depending on the instantaneous application thereof, as explained in greater-detail hereinafter.

The ground-installed structures may be associated with external fluid lines, cables, or other connecting structures configured to communicate in some form with the corresponding ground-installed structure. For example, in the case of a sprinkler head, the sprinkler head may be connected to one or more hoses or pipes extending to and/or away from the sprinkler head, depending on the configuration of the associated water system. As another example, in the case of a light fixture, the light fixture may have one or more cords or cables extending to and/or away from the light fixture. The external connecting structures may be disposed underground adjacent the cover 10 in a manner wherein such connecting structures are not exposed at positions surrounding the corresponding ground-installed structure.

The ground-installed structures may alternatively be provided independently of any type of external connection. For example, a solar powered light fixture may be provided in the absence of any type of cable or cord for supplying power to the light fixture. Other posts, poles, ornaments, or decorations suitable for use with the cover 10 may likewise be provided without the need for connection to a corresponding fluid or energy source.

The cover 10 aids in preventing undesired interaction with the associated ground-installed structure. It should be apparent to one skilled in the art that the cover 10 may be readily adapted for use with any ground-installed structure while remaining within the scope of the present invention.

The ground-installed structure, such as a sprinkler head, may be located within the middle of a yard of grass such that it is normally difficult to visually identify the ground-installed structure during maintenance processes, such as mowing or weed whipping. If a sprinkler head is used, this may be especially true when the surrounding grass or other adjacent plants grow over the sprinkler head or to a height obscuring the view of the sprinkler head from the perspective of the person performing the maintenance process. This failure to identify the location of the sprinkler head may lead to the person mowing or weed whipping directly over the sprinkler head, thereby leading to damage to the mower, string trimmer, and/or the sprinkler head.

In other circumstances, the ground-installed structure may be located adjacent various structures or landscaping features that are difficult to reach or positioned awkwardly when attempting to perform maintenance adjacent the ground-installed structure. For example, the ground-installed structure may be positioned adjacent a sidewalk, driveway, building structure, large plant, or any combination or intersection of the listed elements.

The cover 10 according to the present invention beneficially allows for the customization of the form and configuration of the cover 10 while protecting the associated ground-installed structure, allowing for visual identification thereof, and preventing growth of grass, weeds, or other such plants over the ground-installed structure.

The cover 10 generally includes a tube 20, a flanged portion 40, and at least one removable 60 formed within the tube 20. The entirety of the cover 10, including each of the tube 20, the flanged portion 40, and each of the removables 60, may be formed from a single unitary and monolithic structure. The different components forming the cover 10 may alternatively be referred to as being integrally formed. The cover 10 is formed from any suitable manufacturing process allowing such an integral formation thereof, such as molding or casting. However, other processes may be employed to form the unitary structure of the cover 10, such as an additive manufacturing process (3-D printing) or a subtractive manufacturing process (machining, cutting, etc. with respect to a block of suitable material). The cover 10 may also be formed by the subsequent coupling together of the individual components as described hereinafter, but such a configuration disadvantageously complicates the manufacturing process for forming the cover 10 and requires the use of additional fasteners or coupling means.

The cover 10 may be formed from a material well suited for the aforementioned molding or casting process. For example, the cover 10 may be formed from a plastic material, such as a suitable thermoset or thermoplastic. Suitable materials may include nylon or polyvinyl chloride (PVC), as non-limiting examples. Such a plastic material may also include any desired fillers or the like for altering the characteristics of the plastic, such as providing greater strength, increased stiffness, increased UV resistance, increased scratch resistance, increased corrosion resistance, desired heat and electrical conductivity, or the like, as desired. The cover 10 may be formed from a suitable fiberglass, for example. As explained in greater-detail hereinafter, the use of a plastic material may allow for the reconfiguring of the various features of the cover 10, such as by allowing for a desired bending, breaking, shearing, or tearing of the cover 10 at prescribed locations. The cover 10 may also be formed from a moldable metallic material for certain heavy-duty applications. The metallic material may be an aluminum alloy or steel alloy, as non-limiting examples. It should also be apparent to one skilled in the art that the cover 10 may alternatively be formed from any material having the characteristics corresponding to the features of the cover 10 described hereinafter.

The material forming the cover 10 may be formed to have a desired color for blending in with the surroundings thereof. For example, the cover 10 may be provided to include an exposed color matching the grass or other plants adjacent the cover 10. However, any color may be utilized while remaining within the scope of the present invention.

The tube 20 may be substantially cylindrical in shape and may include a circumferential wall 22 having an inner surface 23 and an oppositely arranged outer surface 24. The inner surface 23 may define a cylindrical opening 25 through an interior of the tube 20 configured to receive the corresponding ground-installed structure such as the described sprinkler head therein. The flanged portion 40 extends radially outwardly from the outer surface 24 of the circumferential wall 22 about at least a portion of a periphery of the tube 20.

The circumferential wall 22 of the tube 20 is divided into a first portion 31 and a second portion 32, wherein a division of the circumferential wall 22 into the described portions 31, 32 occurs at the position of the radial outward extension of the flanged portion 40. The first portion 31 forms a penetrating portion of the tube 20 configured for penetration into the ground surface surrounding the sprinkler head or other associated ground-installed structure. The first portion 31 is accordingly normally arranged to depend downwardly from the position of the flanged portion 40 when the cover 10 is in the installed position relative to the ground.

The first portion 31 may include any desired length with respect to an axial direction of the tube 20 for stabilizing the cover 10 such that the cover 10 does not become dislodged when interfered with externally. For example, the first portion 31 should be dimensioned to remain within the ground when the exposed second portion 32 and/or flanged portion 40 are incidentally stepped on or otherwise contacted following installation of the cover 10. The axial length of the first portion 31 is selected to cause the flanged portion 40 to be disposed immediately adjacent or in direct contact with the exposed surface of the ground when the cover 10 is in the fully installed position. The first portion 31 may be selected to include an axial length that is greater than an axial length of the second portion 32. In some embodiments, the first portion 31 may include an axial length that is a multiple of the axial length of the second portion 32, such as being at least twice as great, at least three times as great, at least four times as great, at least five times as great, and so on, so as to ensure stability of the cover 10 following installation thereof. A thickness of the circumferential wall 22 with respect to the radial direction of the cover 10 may be selected to ensure that the cover 10 can withstand the forces required to cause the penetration of the first portion 31 into the ground. An inner diameter of the circumferential wall 22 along the first portion 31 is selected to be great enough to encircle the corresponding sprinkler head or other structure along at least the length of the first portion 31. It should be readily apparent that any combination of dimensions for the described aspects of the cover 10 may be utilized while remaining within the scope of the present invention so long as the resulting cover 10 is capable of operating in the manner described herein. For example, different lengths, thicknesses, and diameters may be selected for different applications of the cover 10, including different ground materials or different ground-installed structures in need of protection.

An end 33 of the first portion 31 disposed opposite the flanged portion 40 may include a slight taper to form a pointed annular surface configured to aid in penetrating the ground material (typically soil) to the desired depth. The inner surface 23 and/or the outer surface 24 of the circumferential wall 22 may be arranged parallel to the axial direction of the tube 20 along the first portion 31 or may each include a very slight taper (for example, less than 1 degree) along the first portion 31, as desired.

The second portion 32 forms a rim extending upwardly away from the flanged portion 40 when the cover 10 is in the installed position. The second portion 32 is shown as including a smaller axial length than the first portion 31 in the illustrated embodiment, but it should be apparent that the ratio of the lengths between the different portions 31, 32 may be altered while remaining within the scope of the present invention. The axial length of the second portion 32 may be selected for the given application to ensure that the surrounded sprinkler head or the like does not extend vertically beyond an end 34 of the second portion 32 disposed opposite the flanged portion 40. However, as mentioned previously, in some circumstances the ground-installed structure may be a pole or post that is intended to extend beyond the end 34 of the second portion 32.

Figure 3:
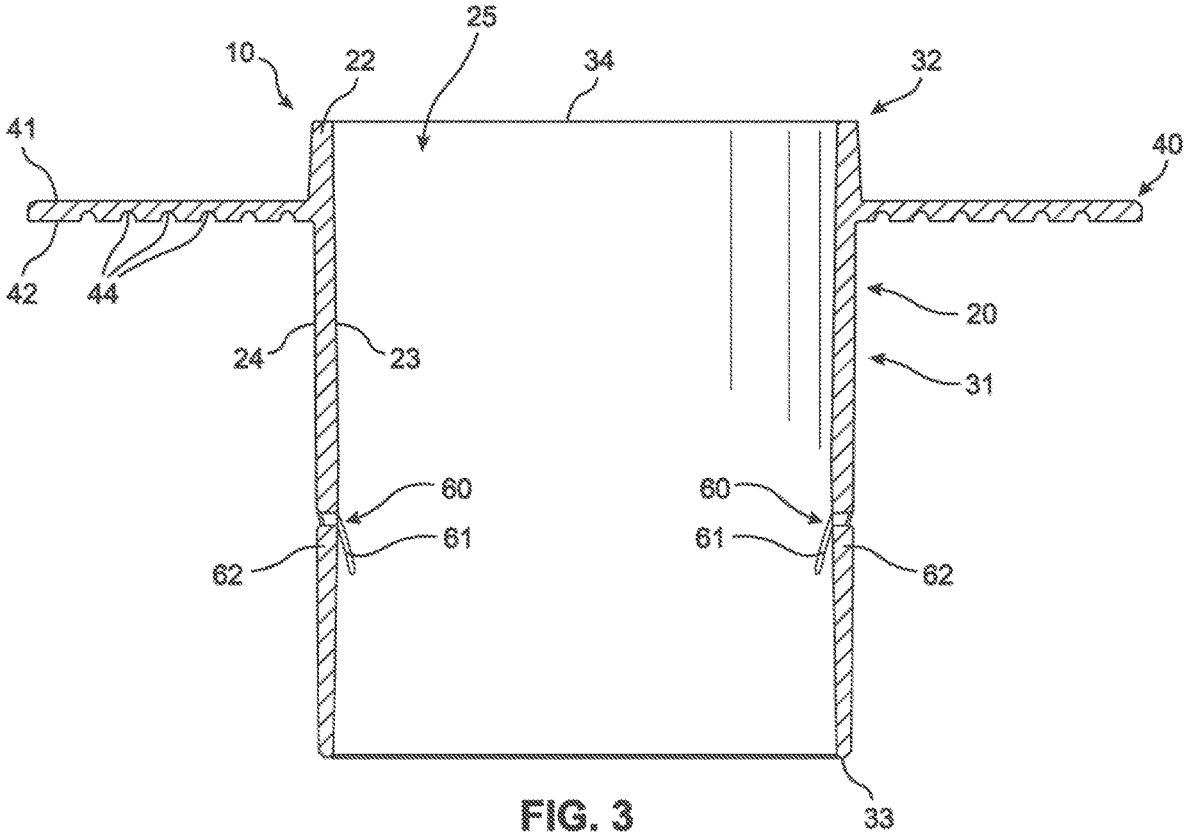
FIG. 3 is a cross-sectional view taken through an axial center of the cover.
Figure 4:
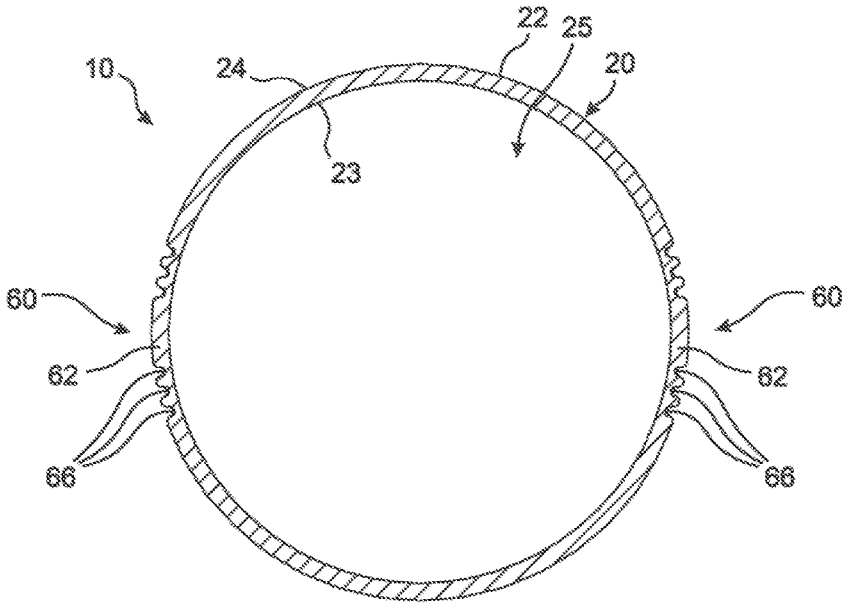
FIG. 4 is a cross-sectional view taken from an axial perspective through an opposing pair of removables formed in the cover.

As can be seen in FIG. 3, the second portion 32 may include a slightly larger thickness than the first portion 31, but alternative configurations may be utilized including each of the portions 31, 32 having the same thickness. The outer surface 24 of the circumferential wall 22 along the second portion 32 is also shown as having a larger taper than the corresponding portion of the inner surface 23, but alternative tapers including the surfaces 23, 24 being arranged parallel to the axial direction of the tube 20 may also be utilized without departing from the scope of the present invention.

The illustrated flanged portion 40 is annular in shape and includes a circular perimeter shape. The flanged portion 40 may extend away from the outer surface 24 of the circumferential wall 22 any suitable distance, as desired. As mentioned previously, the flanged portion 40 is configured to be disposed immediately adjacent the ground surface or to engage the ground surface depending on the depth of the first portion 31 of the tube 20 within the ground. In some circumstances, such as when the cover 10 is installed within a yard, the flanged portion 40 aids in preventing grass or other plants from growing over or around the opening 25 and the corresponding ground-installed structure. This prevents the sprinkler head or the like from being obscured by the overgrowing grass. The flanged portion 40 may also be provided to space the tube 20 from any surrounding structures or the like to ensure that the cover 10 and the corresponding sprinkler head are visually identifiable and easy to be avoided.

The flanged portion 40 is relatively thin-walled and includes a first surface 41 that is normally facing upwardly and exposed and a second surface 42 that is normally facing downwardly towards the ground surface when the cover 10 is in the installed position. The surfaces 41, 42 are each disclosed as being arranged substantially perpendicular to the axial direction of the tube 20, but may alternatively be provided with a relatively small taper.

Figure 7:
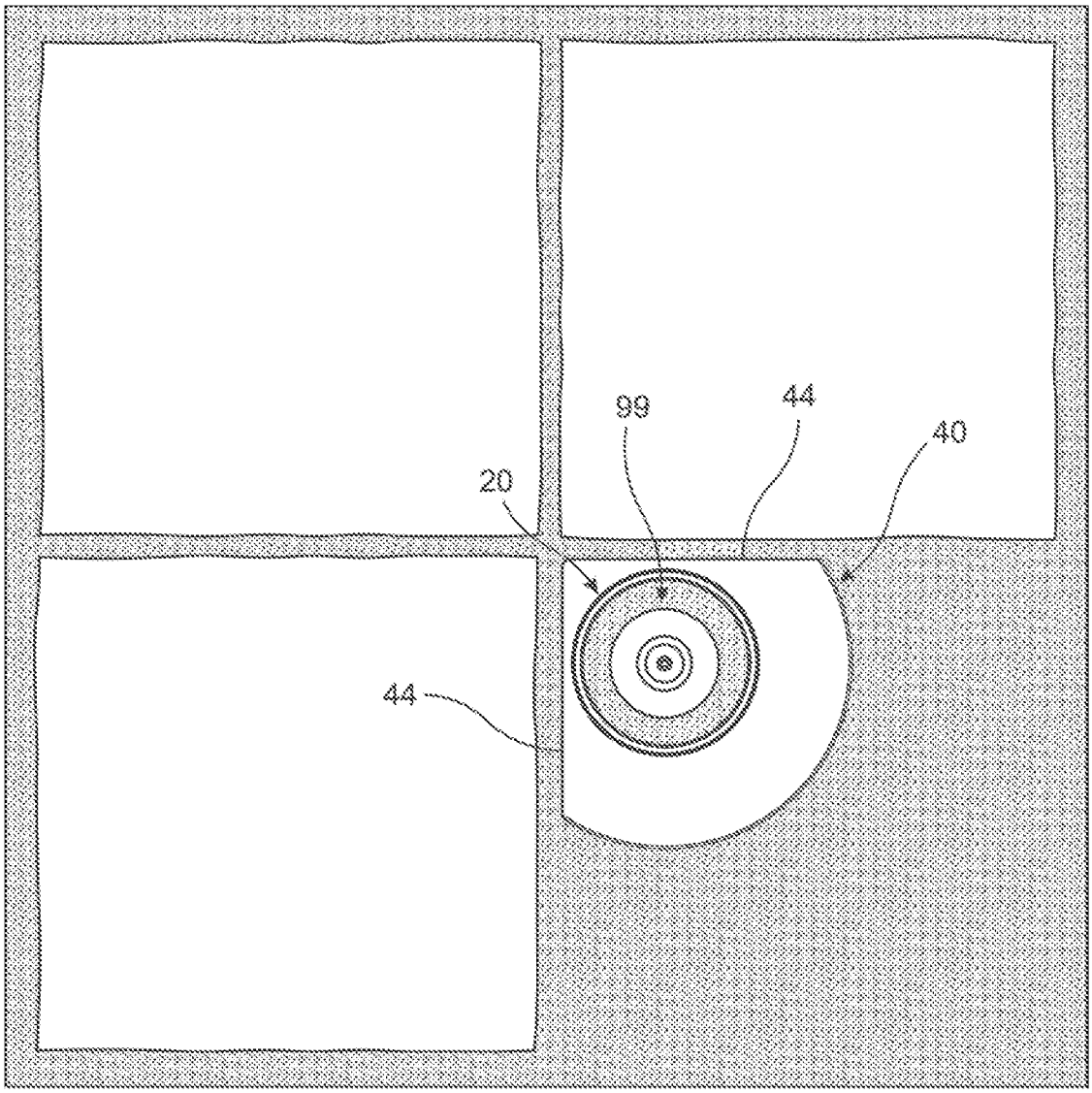
FIG. 7 shows the cover of FIGS. 1-4 in one exemplary implementation wherein the flanged portion thereof is reconfigured to place the cover adjacent a corner structure.

The second surface 42 of the flanged portion 40 includes a plurality of separation features 44 formed therein. Each of the separation features 44 is a portion of the flanged portion 40 at which the flanged portion 40 may be torn, broken, cut, or otherwise separated for reconfiguring the shape and configuration of the flanged portion 40. Such separation may be configured to occur at forces consistent with manual manipulation of the flanged portion 40, such as a bending, folding, or tearing of the flanged portion 40 along those separation features 44 where a separation is desired. The separation features 44 accordingly allow for the otherwise circular shape of the flanged portion 40 to be modified to different configurations for placing the cover 10 adjacent a variety of different structures. For example, as shown in FIG. 7, the cover 10 may be adapted for reception adjacent a corner or the like in a manner wherein the flanged portion 40 does not interfere with the surrounding brick or concrete forming the corner.

Each of the separation features 44 is shown herein as being formed as an indentation or groove penetrating the second surface 42 in a direction towards the oppositely arranged first surface 41. The thinning of the flanged portion 40 at each of the separation features 44 relative to the remainder of the flanged portion 40 accordingly aids in breaking or cutting the flanged portion 40 at the prescribed locations for forming the desired shape of the flanged portion 40. In addition to the illustrated indentations or grooves, the separation features 44 may alternatively be provided as perforations, a series of slots or other elongate openings, scored surfaces, or the like, so long as the breaking or cutting of the flanged portion 40 is facilitated at each of the desired separation features 44. The separation features 44 may also be provided as combinations of the above listed possibilities, such as grooves further including perforations therethrough. In each case, the separation features 44 are configured to aid in facilitating the separation of the material forming the cover 10 at the prescribed locations for removing portions of the flanged portion 40. For example, if the cover 10 is formed from a plastic material, the thinning of the plastic material or the periodic openings formed through the plastic material aid in facilitating a fracture of the flanged portion 40 along one of the separation features 44 via a bending of the flanged portion 40 about the desired separation feature 44. Alternatively, the relatively thin material, perforations, or scoring may form a guide for more easily cutting through the flanged portion 40 at the desired locations using a suitable cutting tool. In either event, the separation features 44 aid in reconfiguring the flanged portion 40 to the desired application when at least a portion of the flanged portion 40 is removed via a separation at at least one of the separation features 44. The reconfiguring of the flanged portion 40 may include changing a perimeter shape of the flanged portion 40, changing an area of the ground surface overlayed by the flanged portion 40, and combinations thereof.

The separation features 44 are shown as being provided in four different sets 44*a*, 44*b*, 44*c*, 44*d*. The first set 44*a* is arranged tangential to the tube 20 at a first position, the second set 44*b* is arranged tangential to the tube 20 at a second position angularly displaced 90 degrees from the first position, the third set 44*c* is arranged tangential to the tube 20 at a third position angularly displaced 90 degrees from the second position, and the fourth set 44*d* is arranged tangential to the tube 20 at a fourth position angularly displaced 90 degrees from the third position. The different sets 44*a*, 44*b*, 44*c*, 44*d* are arranged in a square configuration with the first set 44*a* and the third set 44*c* arranged parallel to and opposite each other and the second set 44*b* and the fourth set 44*d* similarly arranged parallel to and opposite each other. This results in the first and third sets 44*a*, 44*c* also being arranged perpendicular to each of the second and fourth sets 44*b*, 44*d*. The different sets 44*a*, 44*b*, 44*c*, 44*d* also meet and intersect each other at each of the corners of the square array thereof.

In the provided embodiment, each of the sets 44*a*, 44*b*, 44*c*, 44*d* of the separation features 44 includes six parallel arranged separation features 44 spaced apart at intervals extending in the radial direction of the cover 20. Each of the radial intervals is shown as being equal in the provided embodiment, but alternative interval spacings may also be utilized while remaining within the scope of the present invention. The combination of all four sets 44*a*, 44*b*, 44*c*, 44*d*, as illustrated, results in the cover 10 having 1,296 different possible configurations of the flanged portion 40, depending on which of the separation features 44 are utilized in modifying the flanged portion 40. It should be apparent that the addition or subtraction of the separation features 44 may allow for the flanged portion 40 to have different numbers of possible configurations in addition to that listed as an example above, as desired.

Figure 6:
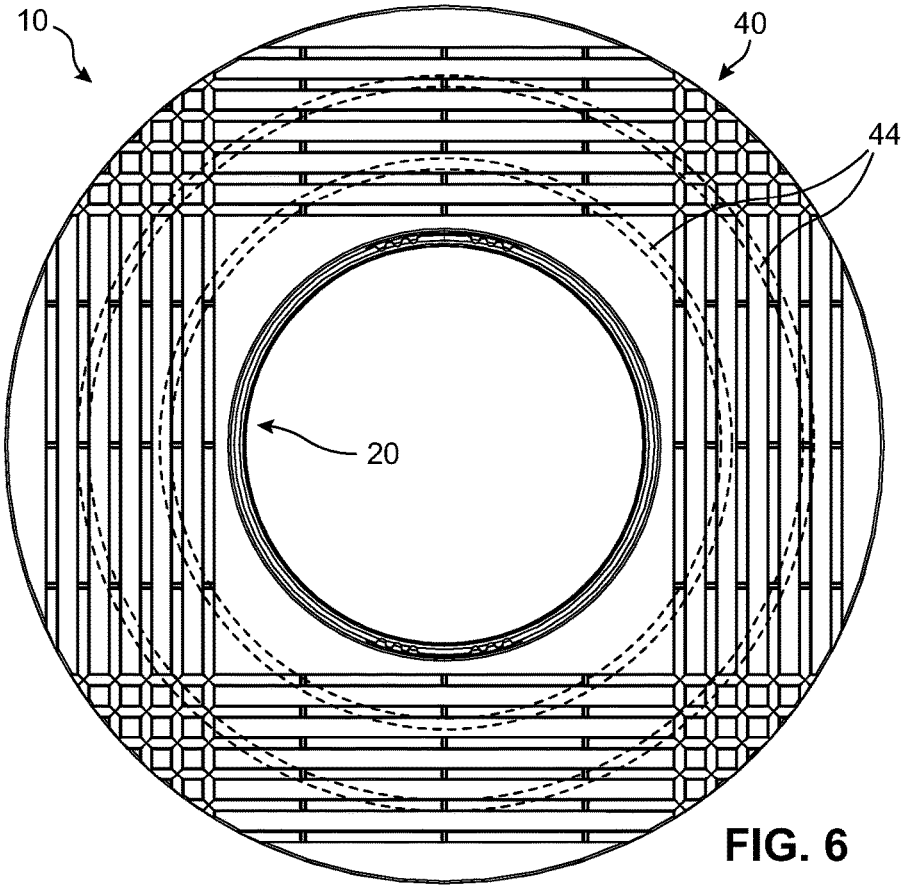
FIG. 6 is a bottom plan view of the cover showing potential locations and shapes for alternative configurations of separation features formed in a flanged portion of the cover.

The square grid-like configuration of the sets 44*a*, 44*b*, 44*c*, 44*d* of the separation features 44 is only one representative example. The separation features 44 may be disposed at variable angles relative to each other for accommodating different configurations of the flanged portion 40, such as including the different sets of the separation features 44 in a hexagonal or octagonal configuration, as desired. Additionally, as shown by phantom lines in FIG. 6, the separation features 44 may alternatively be provided to have non-rectilinear configurations for prescribing different configurations to the flanged portion 40. The provided example shows the possible position of two concentric circular separation features 44 spaced from each other radially. Such circular separation features 44 may be provided to maintain the general appearance of the cover 10 while reducing the radial extension of the flanged portion 40 for fitting the flanged portion 40 into certain spaces.

Although the separation features 44 are shown as being provided in the downwardly facing second surface 42, it should be apparent that the separation features 44 may be formed within the first surface 41 or may be formed by features extending through the flanged portion 40 from the first surface 41 to the opposing second surface 42, as desired, without departing from the scope of the present invention.

The cover 10 is also shown as including a pair of the removables 60 formed within the tube 20. The removables 60 may alternatively be referred to as knock-outs, punch-outs, or removable windows, as desired. In the provided embodiment, the tube 20 includes a pair of the removables 60 spaced angularly from each other by 180 degrees about the circumferential wall 2 to result in the pair of the removables 60 being diametrically opposed to one another. The cover 10 may alternatively be provided with any number of the removables 60, including only one of the removables 60, or three or more of the removables 60, as desired. Each of the removables 60 forms a portion of the circumferential wall 22 that may be removed to facilitate entry of a corresponding fluid line (hose, conduit, pipe, etc.), cable, or other communicating structure into the opening 25 for connection to the corresponding ground-installed structure such as a sprinkler head or a light fixture. The use of the diametrically opposed removables 60 may facilitate the extension of the corresponding fluid line or cable through the cover 10 in a rectilinear direction. However, the removables 60 may be disposed at any angular positions relative to each other, including being disposed at 90 degrees relative to each other, as desired. If three or more of the removables 60 are utilized, any angular displacement may be present between each adjacent pair of the removables 60.

Figure 5:
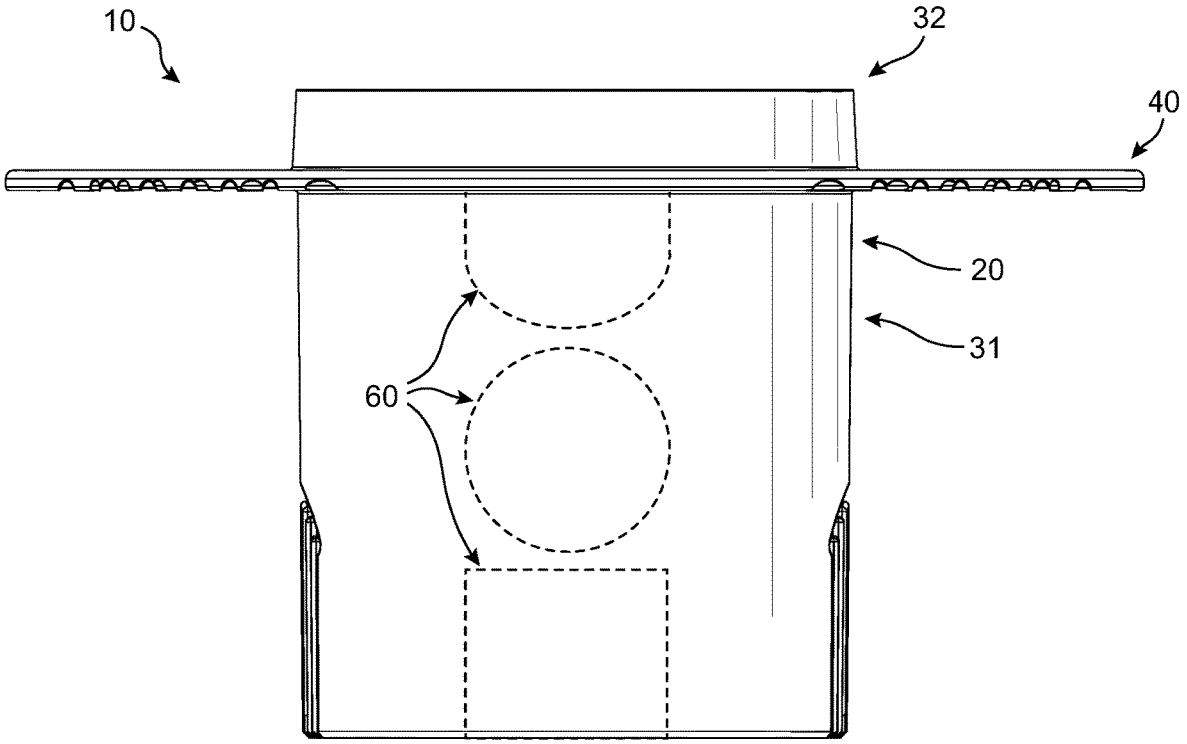
FIG. 5 is a side elevational view of the cover showing potential locations and shapes for alternative removable configurations.

In the provided embodiment, each of the removables 60 intersects the end 33 of the first portion 31 of the circumferential wall 22 such that the end 33 forms a portion of the perimeter of each of the removables 60. However, as shown by the removables 60 shown by the broken lines in FIG. 5 representing alternative positions of the removables 60, the removables 60 may be disposed immediately adjacent the flanged portion 40 or intermediate the end 33 and the flanged portion 40, as desired. If multiple of the removables 60 are utilized, the removables 60 may be axially spaced from each other, circumferentially spaced from each other, or combinations thereof, as desired.

In the provided embodiment, each of the pair of the removables 60 is formed by a crescent shaped slot 61 spaced axially from the end 33 and a plurality of separation features 66 extending between the slot 61 and the end 33. More specifically, the separation features 66 are arranged with three of the separations features 66 disposed in parallel at each of the opposing lateral ends of the slot 61. A tab 62 is surrounded by the end 33, the slot 61, and the opposing sets of the separation features 66. The use of multiple (three) of the separation features 66 to each side of the tab 62 allows for the size of the resulting hole or opening formed by the removal of the corresponding removable 60 to be customized based on which of the separation features 66 are broken or cut when removing the removable 60. For example, the separation occurring at the innermost pair of the separation features 66 results in a relatively small opening or hole while the separation occurring at the outermost pair of the separation features 66 results in an enlarged and maximized size of the opening or hole.

The separation features 66 are illustrated as being grooves or indentations extending radially inwardly into the circumferential wall 22 from the outer surface 24 towards the inner surface 23, but the separation features 66 may instead be provided as perforations, slots, scored portions, or combinations thereof, so long as the separation features 66 promote separation of the corresponding removable 66 from the remainder of the tube 20 via a breaking or cutting of the material forming the cover 10 in similar fashion to that described with reference to the separation features 44 of the flanged portion 40. The forces required for causing such a separation may also be provided manually, as desired.

Referring again to the phantom lines of FIG. 5, the removables 60 may be provided in a variety of different shapes and configurations in addition to those shown in FIGS. 1-4, including a rectangular perimeter shape, a circular perimeter shape, or any other desired perimeter shape. The removables 60 may also be provided in the absence of the slot 61 and/or the end 33 forming a portion of the perimeter thereof. For example, the separation feature(s) 66 may completely circumscribe the corresponding removable 60 or all but one portion of the corresponding removable 60, as desired. In any event, each of the removables 60 is provided to be selectively removed from the circumferential wall 22 depending on the need for the entry of a fluid line or cable into the opening 25 of the tube 20.

In use, the flanged portion 40 is formed into the desired configuration via the breaking, tearing, or cutting of the flanged portion 40 along the separation features 44 and the removal of the desired removables 60 via the breaking or cutting of the tube 20 at the desired locations along the corresponding separation features 66 to accommodate the corresponding ground-installed structure and any structures surrounding the installed position of the cover 10. The opening 25 of the cover 10 is disposed axially over the ground-installed structure and the first portion 31 of the circumferential wall 22 is pushed into the ground until a desired depth is reached with the flanged portion 40 disposed adjacent or engaging the ground surface. The insertion of the cover 10 into the ground may include aligning any fluid lines or cables with the desired removables 60 to ensure continued communication with the corresponding ground-installed structure, or routing such fluid lines or cables through the desired removables 60 during the installation process.

The cover 10 accordingly surrounds and protects the corresponding ground-installed structure while also optionally improving the ability to visually identify the ground-installed structure. The cover 10 ensures that any maintenance devices (lawn mower, string trimmer, edger, etc.) that may normally be used adjacent the cover 10 first encounter the cover 10 rather than the surrounded ground-installed structure, which can prevent time consuming and costly damage to the ground-installed structure, and especially in comparison to such damage occurring with respect to the plastic molded cover 10. The cover 10 may also be utilized to prevent damage when the ground-installed structure is passed over by various vehicles such as a lawn mower, bobcat, golf cart, or the like. The cover 10 may also be selected to hide the appearance of the surrounded ground-installed structure or to make the location of the ground-installed structure more obvious to avoid unintended interaction therewith, depending on the particular circumstances.

As shown in FIG. 7, the ability to modify the configuration of the flanged portion 40 allows for the cover 10 to be installed in positions or orientations that otherwise may interfere with the surrounding structures of the yard or landscaping feature. In the example of FIG. 7, the ability to separate and remove two different segments of the flanged portion 40 along two perpendicular arranged and intersecting separation features 44 allows for the flanged portion 40 to be reconfigured to include a right-angled corner. In the given example, the presence of this right-angled corner allows for the cover 10 to be installed at a position surrounding a ground-installed structure 99 that would otherwise be interfered with due to the proximity of the ground-installed structure 99 to an adjacent landscaping feature, such as a corner of a paver stone arrangement. It should be readily apparent that similar modifications may be utilized for customizing the cover 10 to a variety of different circumstances in addition to that shown, as desired.

Although the cover 10 is described as being reconfigured via the removal of the desired removables 60 and the shaping of the flanged portion 40 via the separation features 44, it should be apparent that the cover 10 may be utilized in the absence of the need to reconfigure the cover 10 or to utilize only those features necessary for the given application. For example, when utilized in the middle of a yard, the cover 10 may not require any reconfiguring of the flanged portion 40. Alternatively, there may not be any need to manipulate any of the removables 60 if no external connection such as a water line or a cable is associated with the ground-installed structure. It should also be apparent that the cover 10 may be provided in the absence of the removables 60 or the separation features 44 formed in the flanged portion 40 while still appreciating the other beneficial properties of the cover 10, depending on the circumstances.

Although the cover 10 is shown and described herein as having a cylindrical configuration with a circular disc forming the flanged portion 40, it should be apparent that the cover 10 may be provided to include alternative cross-sectional shapes while maintaining the beneficial characteristics of the present invention. For example, the cover 10 may include a square cross-sectioned tube 20 and a square-shaped flanged portion 40 projecting radially outwardly therefrom while maintaining the use of the described separation features for breaking or cutting the cover to the desired configuration. Other shapes may include hexagonal shapes, octagonal shapes, elliptical shapes, or others, as desired. The separation features 44 utilized in such a cover 10 may be formed in any desired configuration for allowing the corresponding peripheral shape of the cover 10 to be adapted to the desired configurations, as is suitable for the given application.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A cover for protecting a ground-installed structure, the cover comprising:

a tube defining a first opening for receiving the ground-installed structure therein, wherein the tube includes a circumferential wall having at least one removable formed in the circumferential wall at a bottommost terminal axial end of the tube, wherein a removal of the at least one removable forms a second opening in the circumferential wall, wherein the at least one removable is formed by a crescent shaped slot and at least one first separation feature formed through the circumferential wall, wherein the slot is spaced axially away from the bottommost terminal axial end and the at least one first separation feature extends between the slot and the bottommost terminal axial end, and wherein the at least one removable is configured to selectively increase a width of the second opening relative to the bottommost terminal axial end of the tube; and a flanged portion integrally formed with and extending radially outwardly from the tube, the flanged portion including at least one second separation feature formed therein.

2. The cover of claim 1, wherein each of the at least one removable is configured to be selectively removed from the circumferential wall to promote entry of a fluid line or a cable into the opening for connection to the ground-installed structure.

3. The cover of claim 1, wherein the at least one first separation feature is one of an indentation, a perforation, a scored portion, or combinations thereof.

4. The cover of claim 1, wherein a plurality of the first separation features extend transversely from the slot.

5. The cover of claim 1, wherein the flanged portion includes a plurality of second separation features.

6. The cover of claim 5, wherein at least two of the plurality of the second separation features are arranged transversely to each other.

7. The cover of claim 5, wherein at least two of the plurality of the second separation features intersect each other.

8. The cover of claim 5, wherein adjacent ones of the plurality of the second separation features are spaced apart from each other with respect to a radial direction of the tube.

9. The cover of claim 5, wherein the plurality of the second separation features are arranged in a grid pattern.

10. The cover of claim 1, wherein the flanged portion divides the tube into a first portion and a second portion, and wherein an axial length of the first portion is greater than an axial length of the second portion.

11. The cover of claim 10, wherein the first portion is a penetrating portion of the tube configured to penetrate a surface surrounding the ground-installed structure and the second portion extends axially from the flanged portion beyond an end of the ground-installed structure so that no part of a nozzle of the ground-installed structure extends beyond a topmost terminal axial end of the first portion.

* * * * *